US012674644B2

(12) United States Patent
Cook

(10) Patent No.: US 12,674,644 B2
(45) Date of Patent: Jul. 7, 2026

(54) SHOWER MOUNTED GUN SAFE DEVICE

(71) Applicant: Jeff Cook, Kemah, TX (US)

(72) Inventor: Jeff Cook, Kemah, TX (US)

( * ) Notice: Subject to any disclaimer, the term of this patent is extended or adjusted under 35 U.S.C. 154(b) by 42 days.

(21) Appl. No.: 18/781,197

(22) Filed: Jul. 23, 2024

(65) Prior Publication Data

US 2026/0029212 A1 Jan. 29, 2026

(51) Int. Cl.
*F41C 33/06* (2006.01)

(52) U.S. Cl.
CPC ..... *F41C 33/06* (2013.01)

(58) Field of Classification Search
CPC .. E05G 1/00; E05G 1/005; E05G 1/02; E05G 1/024; E05G 1/026; F41C 33/00; F41C 33/06
See application file for complete search history.

(56) References Cited

U.S. PATENT DOCUMENTS 2,429,487 A 10/1947 Roberts
3,187,954 A * 6/1965 Hammer ..... A47K 5/1204 222/51
5,056,342 A * 10/1991 Prinz ..... A47C 21/00 109/51
5,143,262 A * 9/1992 Edlund ..... A47K 3/281 222/164
5,183,182 A 2/1993 Comstock
5,586,934 A 12/1996 Dombrowski
D377,877 S 2/1997 Andrus
5,842,609 A * 12/1998 Higgins ..... A47K 5/1204 137/513.5
5,987,941 A * 11/1999 Zocco ..... E05B 47/026 109/59 R
6,724,303 B2 4/2004 McGunn
8,887,960 B2 * 11/2014 Hardman ..... B67D 7/02 222/165
10,472,879 B1 * 11/2019 Galler ..... E05B 53/00
10,989,496 B2 * 4/2021 Bernkrant ..... H04W 4/029
2004/0066275 A1 * 4/2004 Mickler ..... G08B 13/149 340/568.1
2005/0193931 A1 * 9/2005 Boudreau ..... E05B 65/0075 109/50

(Continued)

FOREIGN PATENT DOCUMENTS

DE 202017001623 U1 * 10/2017 ..... E05G 1/005
KR 20170002995 U * 8/2017 ..... A47K 3/02

(Continued)

*Primary Examiner* — Kristina R Fulton
*Assistant Examiner* — Emily G. Brown

(57) ABSTRACT

A shower mounted gun safe device includes a plurality of motion sensing units which are mountable within an occupancy to sense motion within the occupancy. A gun safe is mounted in a shower to be accessible to a user while the user is bathing in the shower for storing a firearm. A communication unit is integrated into the gun safe which emits an audible alert when an alert signal is received from any of the motion sensing units when any of the motion sensing units senses motion. A locking unit is integrated into the gun safe for locking or unlocking the door to permit access to the firearm stored within the gun safe. A plurality of soap dispensing units is attached to the door of the gun safe to dispense a fluid soap for the user to employ for bathing.

12 Claims, 11 Drawing Sheets

(56) References Cited

U.S. PATENT DOCUMENTS

| | | | | |
|---|---|---|---|---|
| 2011/0079170 | A1* | 4/2011 | Al-Mutairi | E05G 1/10 340/568.1 |
| 2011/0175730 | A1* | 7/2011 | Stevenson | E05B 63/0065 340/5.73 |
| 2013/0025511 | A1* | 1/2013 | Maxwell | E05G 1/04 109/59 R |
| 2014/0083338 | A1* | 3/2014 | Mcalexander | B65D 43/16 109/52 |
| 2014/0103785 | A1* | 4/2014 | Richards | E05G 1/024 312/204 |
| 2014/0284232 | A1* | 9/2014 | Feris | F41C 33/06 206/317 |
| 2014/0285668 | A1* | 9/2014 | Deweese | H04N 7/188 348/156 |
| 2015/0332528 | A1 | 11/2015 | McGinnis | |
| 2016/0201379 | A1* | 7/2016 | Dutra | E05B 65/0075 312/224 |
| 2016/0208542 | A1* | 7/2016 | Coons | E05G 1/005 |
| 2017/0107039 | A1* | 4/2017 | Chavez | E05G 1/10 |
| 2018/0372447 | A1* | 12/2018 | Hyde | E05B 47/00 |
| 2019/0226267 | A1* | 7/2019 | Batdorf, III | E05G 1/026 |
| 2020/0397104 | A1* | 12/2020 | Wolf | A45C 13/20 |

FOREIGN PATENT DOCUMENTS

| | | | | |
|---|---|---|---|---|
| WO | WO03034359 | | 4/2003 | |
| WO | WO-2021009678 | A1 * | 1/2021 | E05G 1/04 |

* cited by examiner

SHOWER MOUNTED GUN SAFE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to gun safe devices and more particularly pertains to a new gun safe device for enabling a firearm to be accessible to a user when the user is bathing in a shower. The device includes a plurality of motions sensors for sensing motion within an occupancy in which the shower is positioned. The gun safe includes a communication unit with receives an alert signal from any of the motion sensing units when any of the motion sensing units senses motion and the communication unit emits an audible alert when the communication unit receives the alert signal to alert the user to the presence of a potential home intruder. The device includes a plurality of soap dispensers that are each attached to the gun safe for dispensing a liquid soap for the user to employ while bathing.

(2) Description of Related Art Including Information Disclosed Under 37 CFR 1.97 and 1.98.

The prior art relates to gun safe devices including a gun safe device that in integrated into a bathtub and a variety of safe monitoring devices that each at least includes a safe which has wireless communication capabilities and a security system in wireless communication with the safe for remotely monitoring the safe and a variety of gun safe devices for storing a firearm in a discrete manner within an occupancy. In no instance does the prior art disclose a shower mounted gun safe device that includes a plurality of motion sensors that are positioned within an occupancy and a gun safe that is mounted in a shower within the occupancy which is in wireless communication with the motion sensors and a plurality of soap dispensers that are each attached to the gun safe for dispensing a liquid soap for a user to employ while showering.

BRIEF SUMMARY OF THE INVENTION

An embodiment of the disclosure meets the needs presented above by generally comprising a plurality of motion sensing units which are mountable within an occupancy to sense motion within the occupancy. A gun safe is mounted in a shower to be accessible to a user while the user is bathing in the shower for storing a firearm. A communication unit is integrated into the gun safe which emits an audible alert when an alert signal is received from any of the motion sensing units when any of the motion sensing units senses motion. A locking unit is integrated into the gun safe for locking or unlocking the door to permit access to the firearm stored within the gun safe. A plurality of soap dispensing units is attached to the door of the gun safe to dispense a fluid soap for the user to employ for bathing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
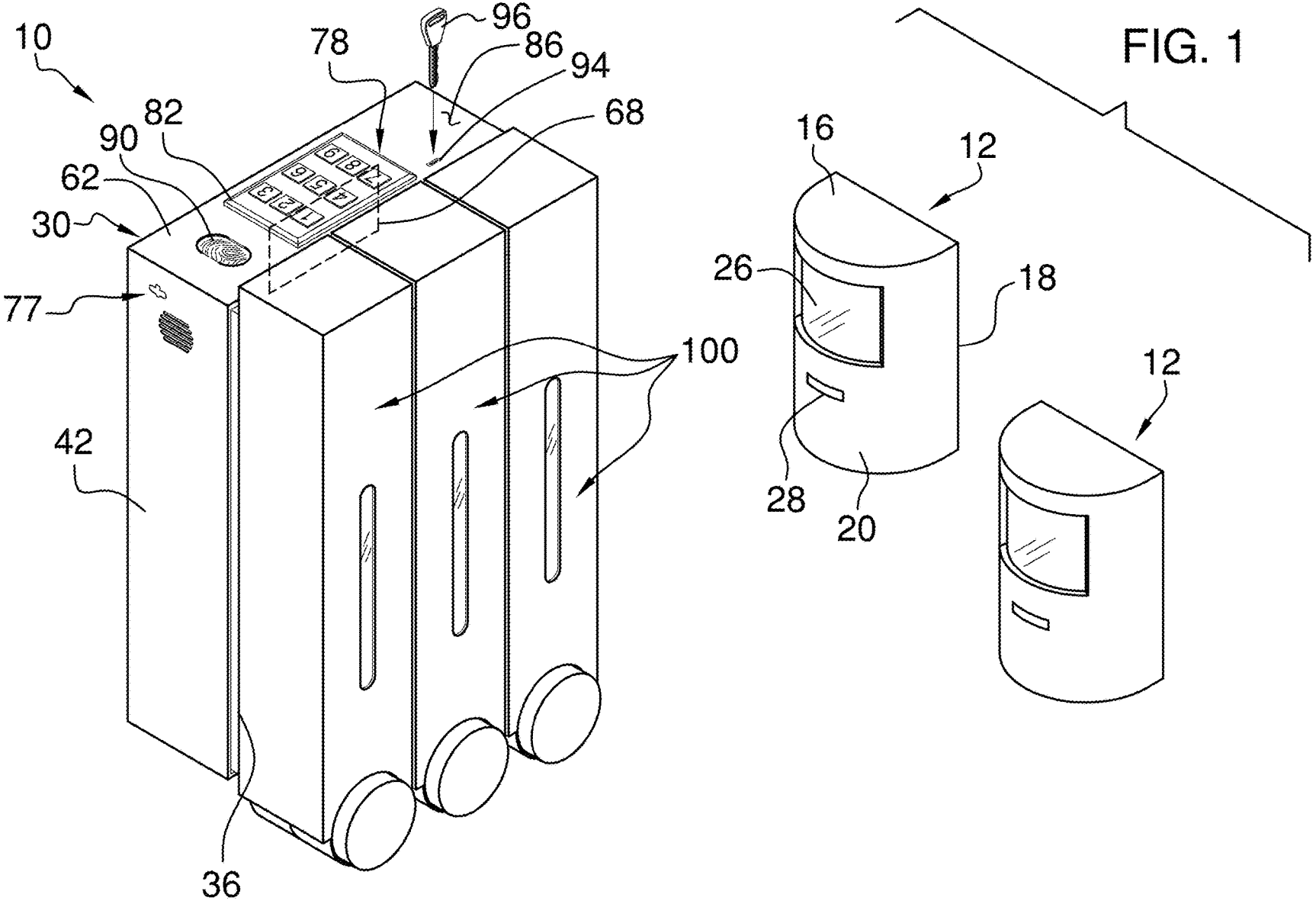
FIG. 1 is a perspective view of a shower mounted gun safe device according to an embodiment of the disclosure.
Figure 2:
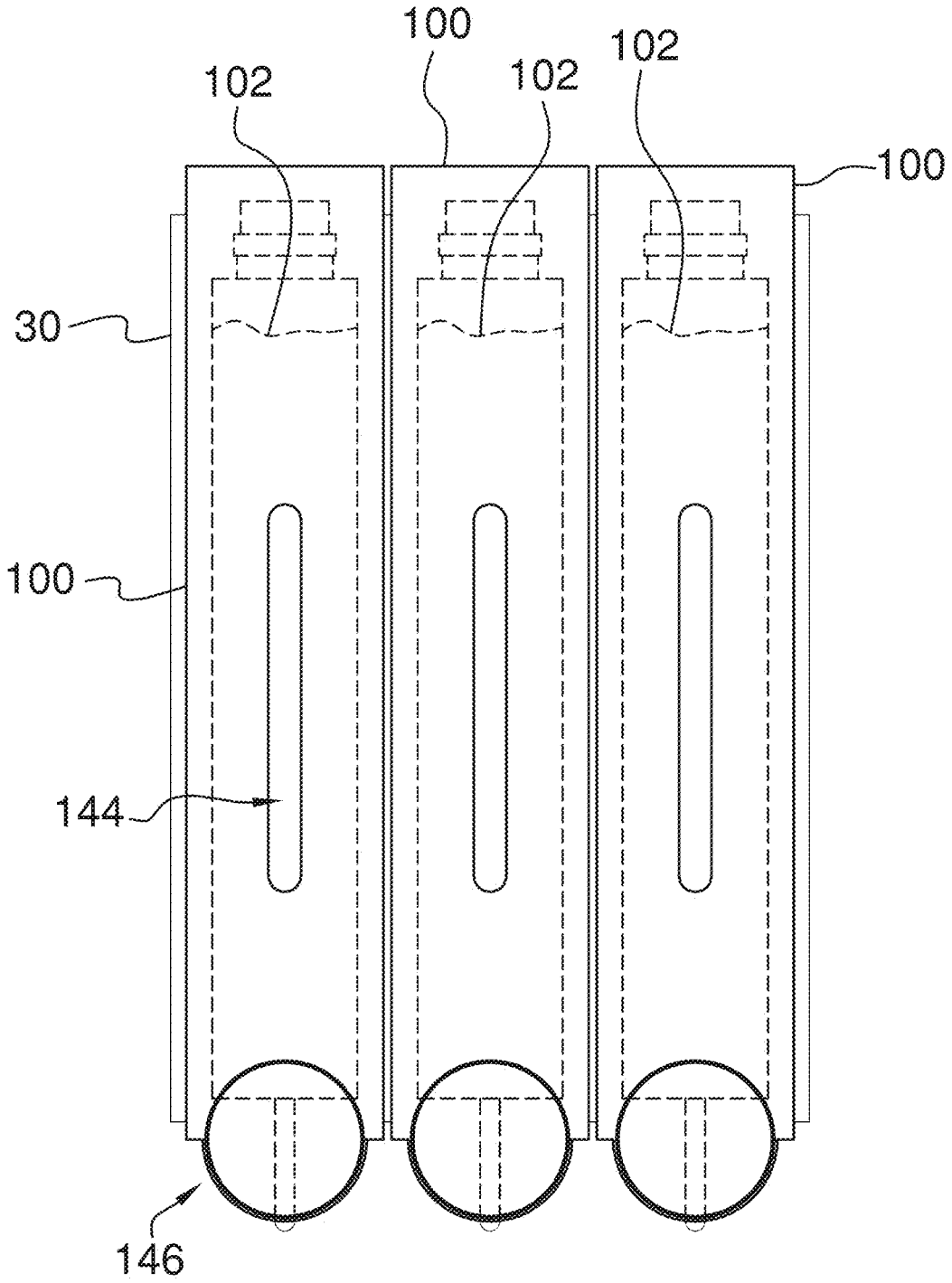
FIG. 2 is a front phantom view of a gun safe of an embodiment of the disclosure.
Figure 3:
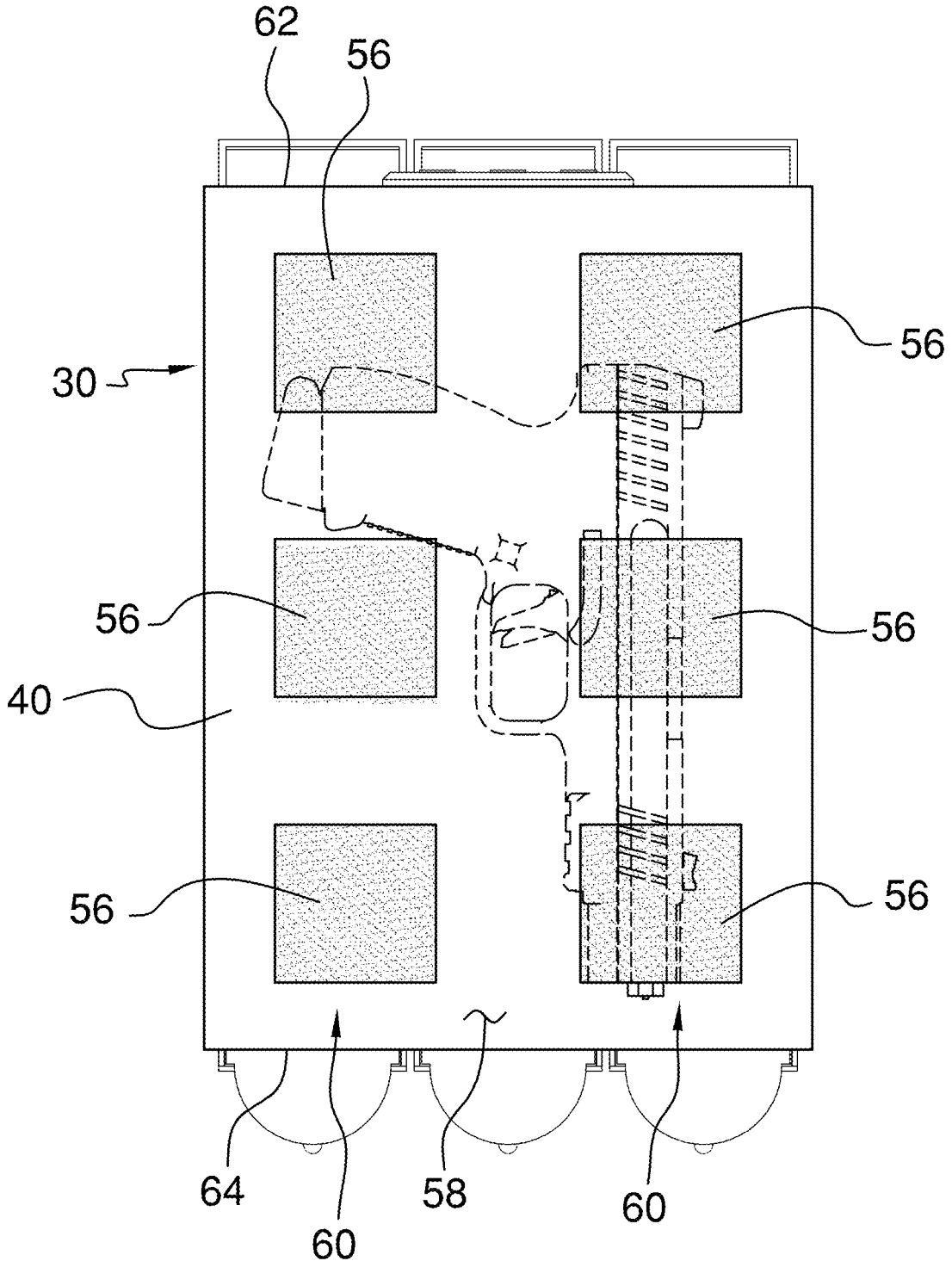
FIG. 3 is a back phantom view of a gun safe of an embodiment of the disclosure.
Figure 4:
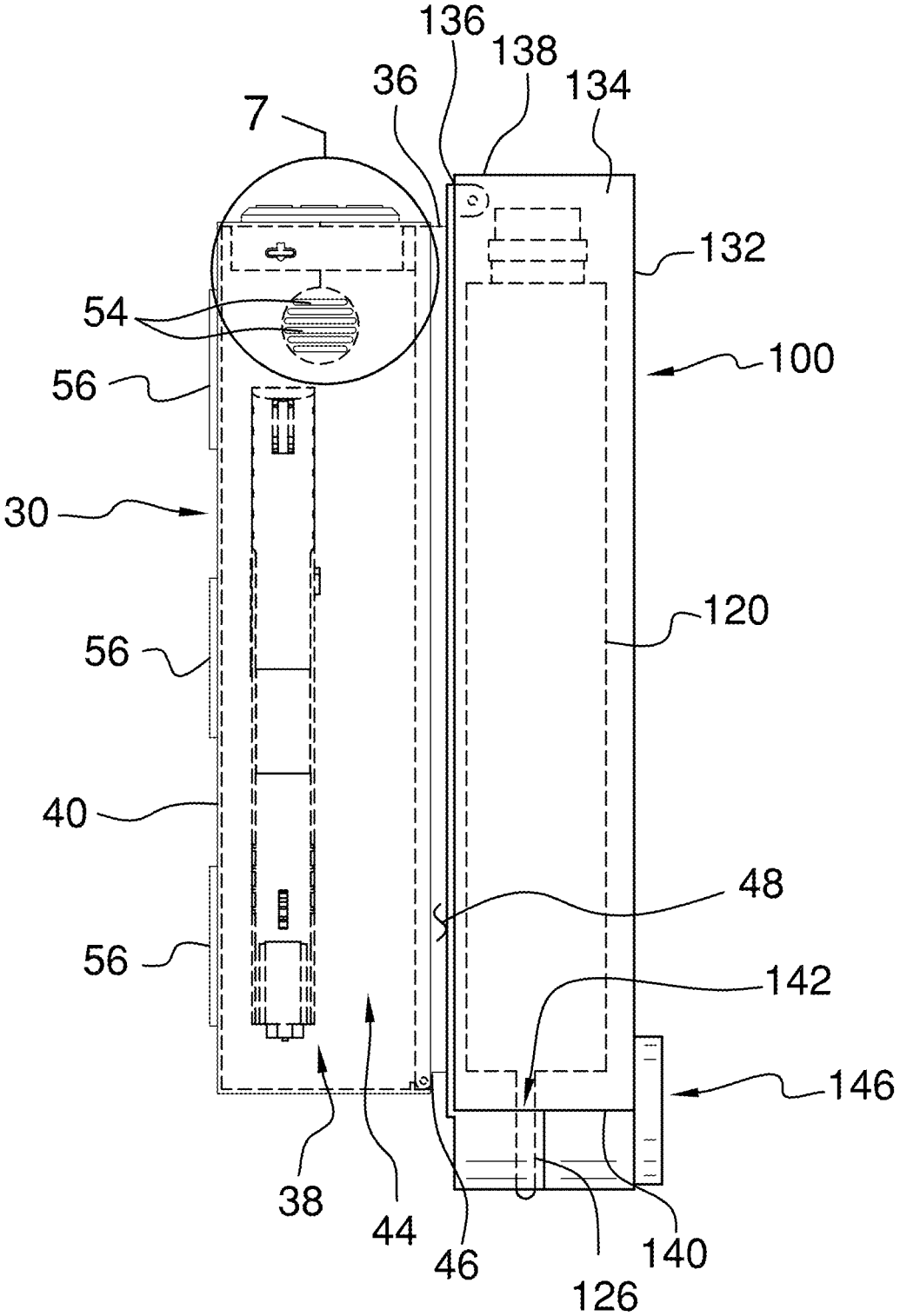
FIG. 4 is a right side phantom view of a gun safe of an embodiment of the disclosure.
Figure 5:
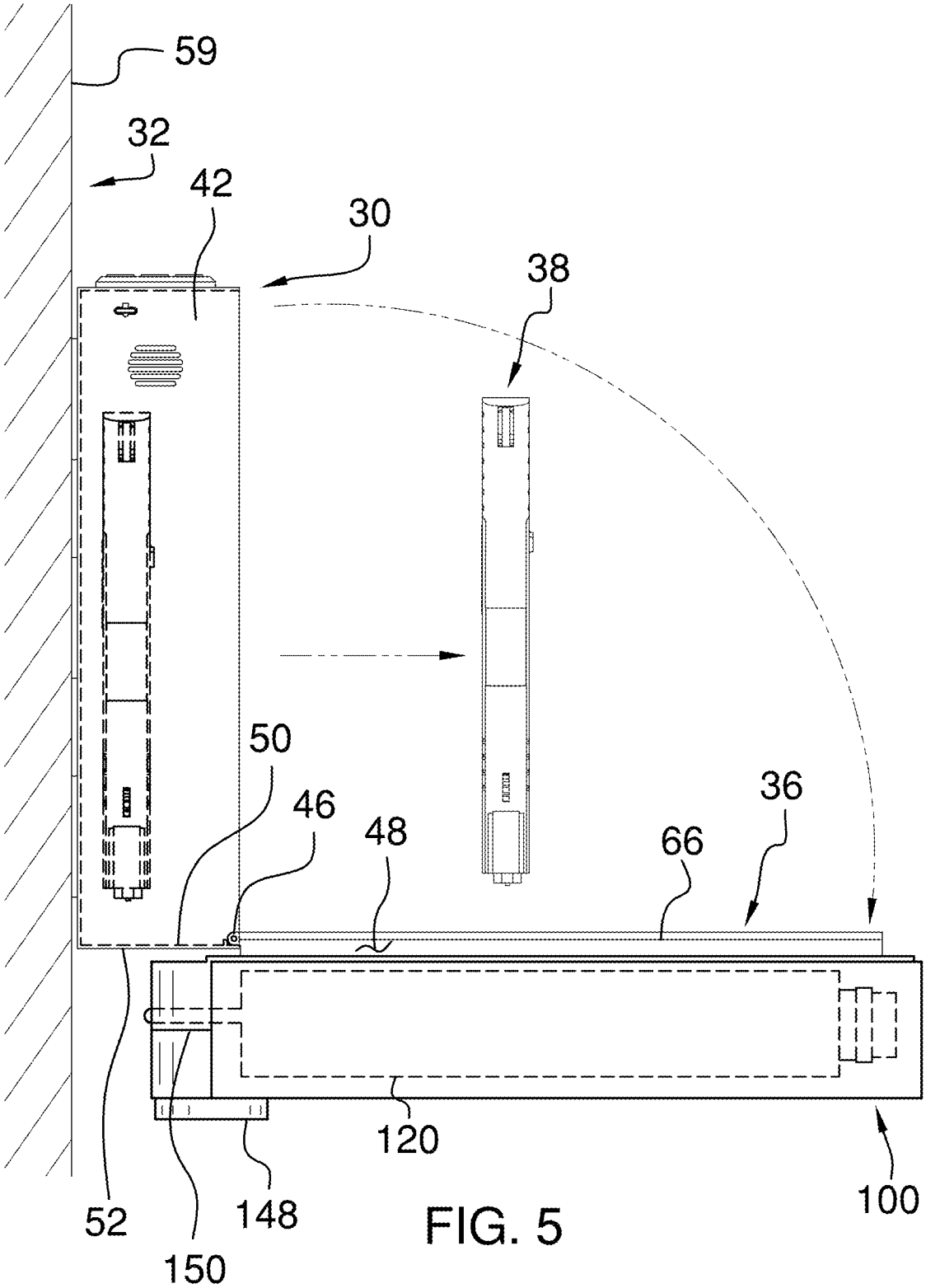
FIG. 5 is a right side phantom view of a gun safe of an embodiment of the disclosure showing a door of gun safe being opened.
Figure 6:
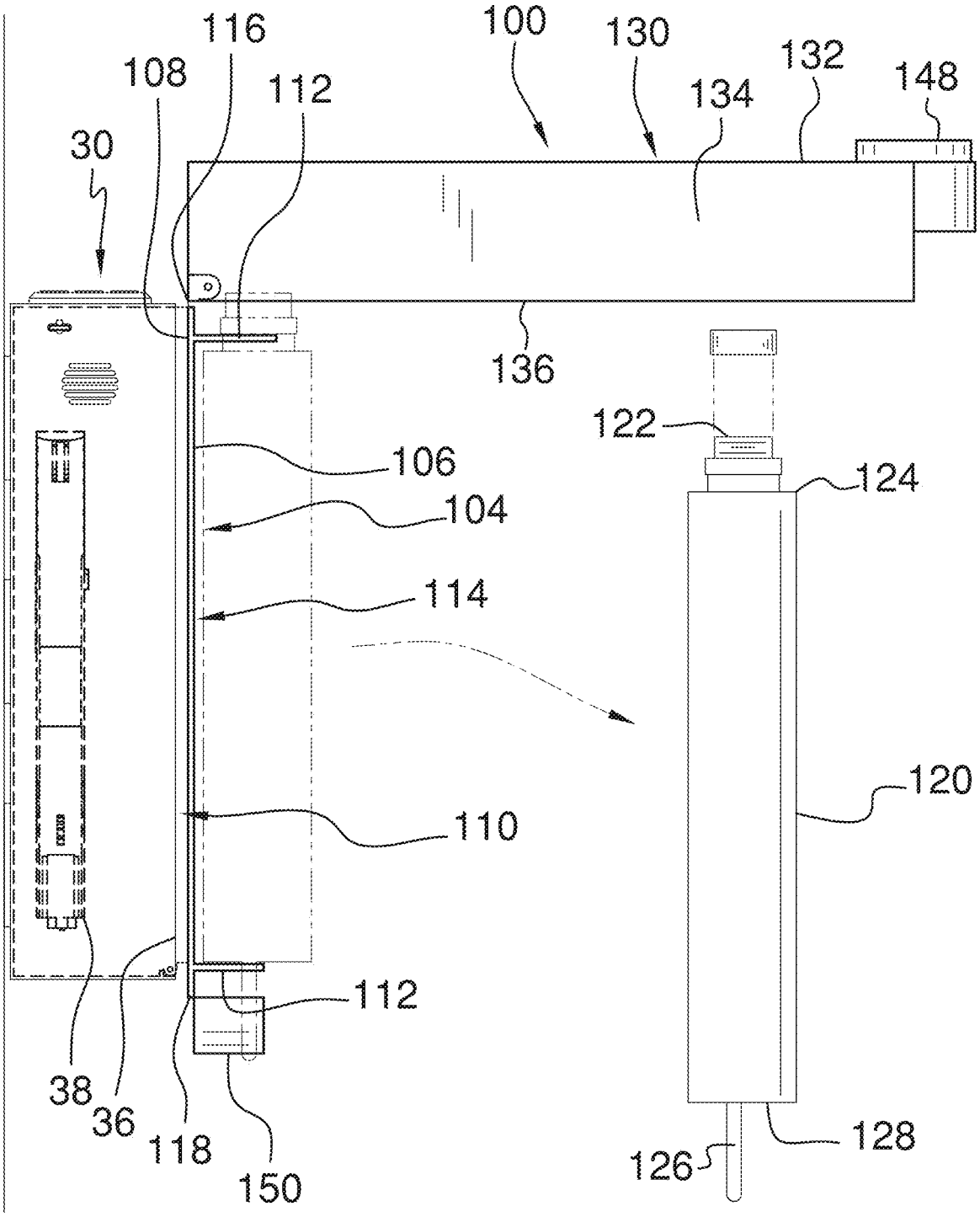
FIG. 6 is a right side phantom view of a gun safe of an embodiment of the disclosure showing a cover on a soap dispenser being opened.
Figure 7:
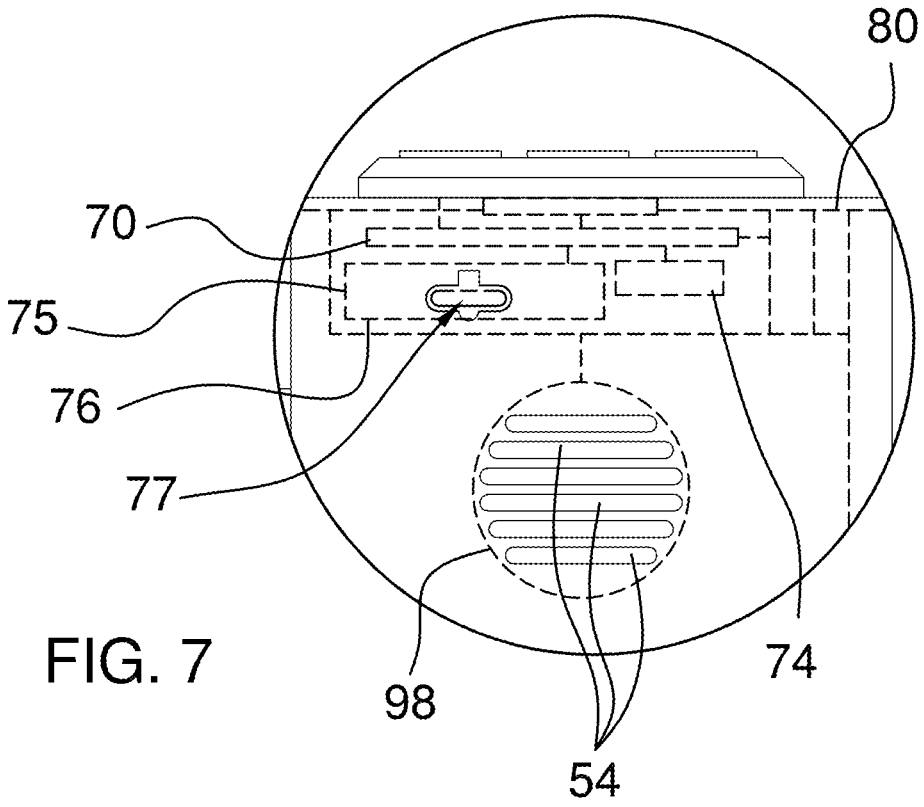
FIG. 7 is a magnified detail view taken from circle 7 of FIG. 4 of an embodiment of the disclosure.
Figure 8:
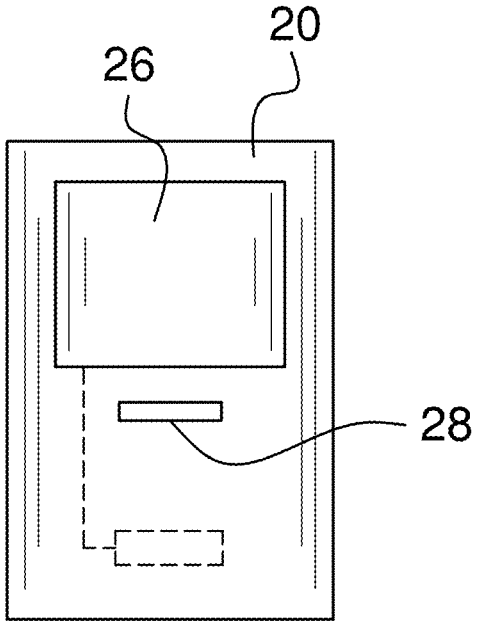
FIG. 8 is a front phantom view of a motion sensing unit of an embodiment of the disclosure.
Figure 9:
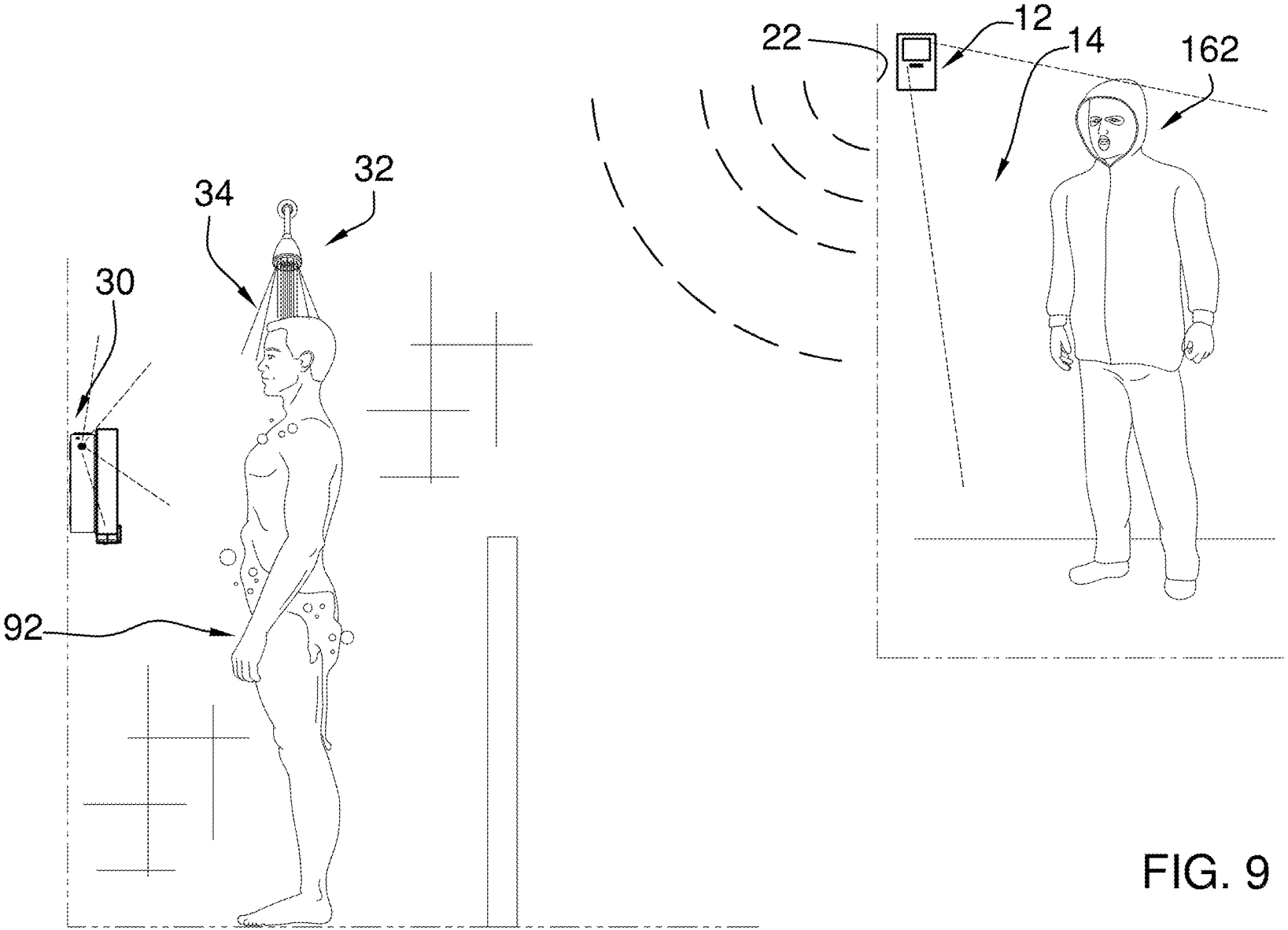
FIG. 9 is a perspective in-use view of an embodiment of the disclosure.
Figure 10:
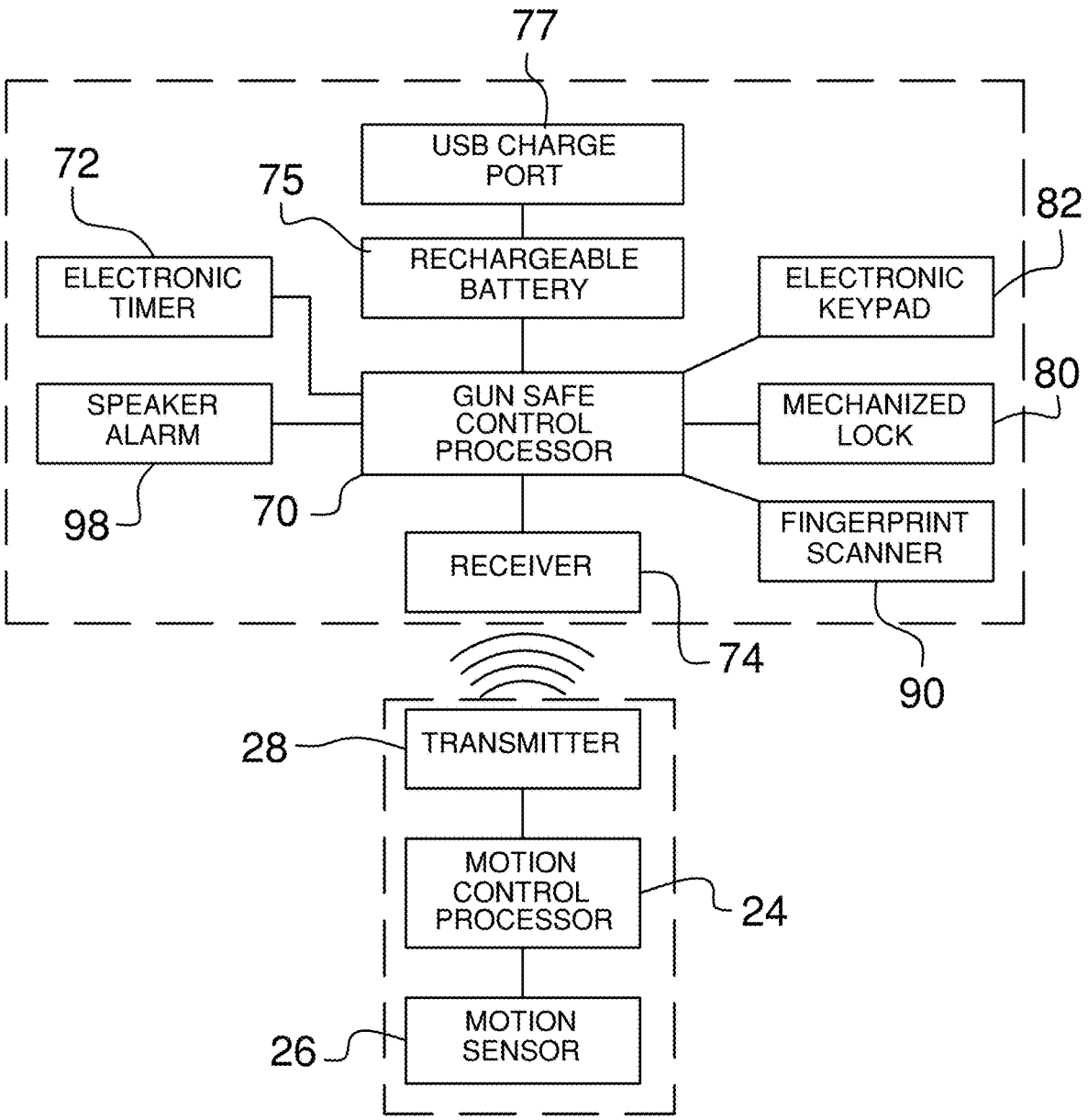
FIG. 10 is a schematic view of an embodiment of the disclosure.

With reference now to the drawings, and in particular to FIGS. 1 through 12 thereof, a new gun safe device embodying the principles and concepts of an embodiment of the disclosure and generally designated by the reference numeral 10 will be described.

As best illustrated in FIGS. 1 through 12, the shower mounted gun safe device 10 generally comprises a plurality of motion sensing units 12 that is each mountable within an occupancy 14 to sense motion within the occupancy 14. The occupancy 14 may be a house, an apartment or any other type of residential occupancy. Each of the plurality of motion sensing units 12 has the capacity to broadcast an alert signal and a respective one of the motion sensing units 12 broadcasts the alert signal when the respective motion sensing unit 12 senses motion within the occupancy 14. Each of the plurality of motion sensing units 12 comprises a motion housing 16 which has a back wall 18 and a forward wall 20 curving forwardly from the back wall 18 such that the motion housing 16 has a semi-cylindrical shape; the back wall 18 is mountable to an interior wall 22 of the occupancy 14.

Each of the motion sensing units 12 includes a motion control processor 24 that is integrated into the motion housing 16 and the motion control processor 24 receives a motion input. The motion control processor 24 is electrically coupled to a power source comprising an electrical system of the occupancy 14. Each of the motion sensing units 12 includes a motion sensor 26 which is integrated into the forward wall 20 of the motion housing 16 to sense motion within the occupancy 14. The motion sensor 26 is electrically coupled to the motion control processor 24 and the motion control processor 24 receives the motion input when the motion sensor 26 senses motion. Additionally, the motion sensor 26 may comprise an infra-red motion sensor of other type of electronic motion sensor which has an operational range of approximately 6.0 meters to 15.0 meters.

Each of the motion sensing units 12 includes a transmitter 28 which is integrated into the motion housing 16 and the transmitter 28 is electrically coupled to the motion control processor 24. Additionally, the transmitter 28 broadcasts the alert signal when the motion control processor 24 receives the motion input. The transmitter 28 may comprise a radio frequency transmitter or the like and the transmitter 28 may employ Bluetooth communication protocols or other type of communication protocol which facilitates discrete communication with an assigned receiver 74.

A gun safe 30 is provided which is comprised of a fluid impermeable material, including but not being limited to steel, aluminum or a metal alloy, thereby enabling the gun safe 30 to be mounted in a shower 32. In this way the gun safe 30 is accessible to a user 34 while the user 34 is bathing in the shower 32. The shower 32 is located within the occupancy 14 and the shower 32 may be a bathing shower of any conventional design, including but not being limited to, a tub/shower combo or a walk in shower. The gun safe 30 has a door 36 which is hingedly attached to the gun safe 30 and the door 36 forms a fluid impermeable seal with the gun safe 30 when the door 36 is in a closed position. In this way the door 36 inhibits water from entering the gun safe 30 thereby protecting a firearm 38 which is stored in the gun safe 30 from becoming wet while the user 34 is bathing in the shower 32.

The gun safe 30 has a rear wall 40 and an outer wall 42 extending forwardly from the rear wall 40 and surrounding the rear wall 40 such that the outer wall 42 defines an interior space 44 in the gun safe 30 to contain the firearm 38. A lower side 46 of an exterior surface 48 of the door 36 is hingedly coupled to an interior surface 50 of a lower side 52 of the outer wall 42. Furthermore, the exterior surface 48 of the door 36 rests against and is surrounded by the interior surface 50 of the outer wall 42 when the door 36 is in the closed position. The gun safe 30 has a plurality of sound slots 54 each extending through the outer wall 42 of the gun safe 30 to enable sound to pass through the plurality of sound slots 54.

A plurality of mounting panels 56 is each attached to an outwardly facing surface 58 of the rear wall 40 of the gun safe 30. Each of the plurality of mounting panels 56 engages a wall 59 of the shower 32 thereby attaching the rear wall 40 of the gun safe 30 to the wall of the shower 32. Furthermore, the plurality of mounting panels 56 is arranged in a pair of columns 60 extending substantially between a top side 62 and the lower side 52 of the outer wall 42 of the gun safe 30. Each of the plurality of mounting panels 56 may be comprised of a water resistant adhesive which adhesively engages the wall 59 of the shower 32.

A gasket 66 is attached to the exterior surface 48 of the door 36 and the gasket 66 is continuous such that the gasket 66 extends around a full perimeter of the exterior surface 48 of the door 36. The gasket 66 abuts against the interior surface 50 of the outer wall 42 of the gun safe 30 when the door 36 is in the closed position. Furthermore, the gasket 66 is comprised of a fluid impermeable material, including but not being limited to rubber or silicone, thereby enabling the gasket 66 to form a fluid impermeable seal with the interior surface 50 of the outer wall 42 of the gun safe 30 when the door 36 is in the closed position. In this way the gasket 66 inhibits water from entering the gun safe 30 when the door 36 is in the closed position.

A communication unit 68 is integrated into the gun safe 30 and the communication unit 68 is in wireless communication with each of the plurality of motion sensing units 12 thereby enabling the communication unit 68 to receive the alert signal from any of the motion sensing units 12. The communication unit 68 comprises a gun safe control processor 70 which is integrated into the gun safe 30; the gun safe control processor 70 receives an alert input and an unlock input. The gun safe control processor 70 includes an electronic timer 72 and the electronic timer 72 is programmable to count down a duration of time which corresponds to the duration of time that the user 34 will be bathing in the shower 32. Furthermore, the gun safe control processor 70 is enabled when the electronic timer 72 begins counting down the duration of time and the gun safe control processor 70 is disabled when the electronic timer 72 finishes counting down the duration of time.

The communication unit 68 includes a receiver 74 which is integrated into the gun safe 30 and the receiver 74 is electrically coupled to the gun safe control processor 70. The receiver 74 is in wireless communication with the transmitter 28 in each of the plurality of motion sensing units 12 thereby enabling the receiver 74 to receive the alert signal from the transmitter 28 in any of the motion sensing units 12. Additionally, the gun safe control processor 70 receives the alert input when the receiver 74 receives the alert signal from the transmitter 28 in any of the motion sensing units 12. The receiver 74 may comprise a radio frequency receiver or the like and the receiver 74 may employ Bluetooth communication protocols or other communication protocol which enables the receiver 74 to be in discrete wireless communication with only the transmitter 28 in each of the motion sensing units 12. The communication unit 68 includes a power supply 76 that is integrated into the gun safe 30. The power supply 76 is electrically coupled to the gun safe control processor 70 and the power supply 76 comprises a rechargeable battery 75 and a charge port 77 recessed into the outer wall 42 of the gun safe 30 which is electrically coupled to the rechargeable battery 75 for charging the rechargeable battery 75.

A locking unit 78 is integrated into the gun safe 30 and the locking unit 78 is in mechanical communication with the door 36. The locking unit 78 locks the door 36 when the door 36 is in the closed position to restrict access to the firearm 38 that is stored within the gun safe 30. Conversely, the locking unit 78 is actuatable into an unlocked condition thereby enabling the door 36 to be positioned in an open position to permit access to the firearm 38 stored within the gun safe 30. The locking unit 78 comprises a mechanized lock 80 which is integrated into the outer wall 42 of the gun safe 30 and the mechanized lock 80 is electrically coupled to the gun safe control processor 70. The mechanized lock 80 is biased into a locking condition having the mechanized lock 80 engaging the exterior surface 48 of the door 36 when the door 36 is in the closed position thereby inhibiting the door 36 from being positioned into the open position. The mechanized lock 80 is actuated to disengage the exterior surface 48 of the door 36 when the gun safe control processor 70 receives the unlock input thereby enabling the door 36 to be positioned into the open position. Furthermore, the mechanized lock 80 may comprise an electro-mechanical lock of any conventional design that is electrically controlled to move between the locking condition and the unlocked condition.

The locking unit 78 includes a key pad 82 which is integrated into the top side 62 of an outer surface 86 of the outer wall 42 of the gun safe 30 such that the key pad 82 is accessible to the user 34 when the user 34 is bathing in the shower 32. The key pad 82 includes a plurality of alpha-numeric keys 88 and the key pad 82 is electrically coupled to the gun safe control processor 70. Furthermore, the gun safe control processor 70 receives the unlock input when the plurality of alpha-numeric keys 88 are depressed to enter a pre-determined unlock code which has been previously established by the user 34. The locking unit 78 includes a biometric scanner 90 which is integrated into the top side 62 of the outer surface 86 of the outer wall 42 of the gun safe 30 to enable to user 34 to position the user's thumb 92 against the biometric scanner 90. The biometric scanner 90 is electrically coupled to the gun safe control processor 70 and the gun safe control processor 70 receives the unlock input when the biometric scanner 90 scans data from the user's thumb 92. Additionally, the biometric scanner 90 may comprise an electronic thumb print reader of any conventional design.

The locking unit 78 includes a keyhole 94 which is integrated into the outer wall 42 of the gun safe 30 thereby enabling the keyhole 94 to insertably receive a key 96. In this way the key 96 can be placed in mechanical communication with the mechanized lock 80 for manually disengaging the mechanized lock 80 from the exterior surface 48 of the door 36. In this way the door 36 can be positioned into the open position without requiring the use of the key pad 82 or the biometric scanner 90. The locking unit 78 includes a speaker 98 which is integrated into the outer wall 42 of the gun safe 30; the speaker 98 is electrically coupled to the gun safe control processor 70 and the speaker 98 is actuated to emit an audible alarm when the gun safe control processor 70 receives the alert input. Furthermore, the speaker 98 is aligned with the plurality of sound slots 54 in the outer wall 42 of the gun safe 30 to enable the user 34 to hear the audible alarm to alert the user 34 to unlock the gun safe 30 to retrieve the firearm 38 from the gun safe 30.

A plurality of soap dispensing units 100 is each attached to the door 36 of the gun safe 30 such that the plurality of soap dispensing units 100 is accessible to the user 34 when the user 34 is bathing in the shower 32. Each of the plurality of soap dispensing units 100 contains a fluid soap 102 which is dispensable from the soap dispensing units 100. In this way the plurality of soap dispensing units 100 enables to user 34 to employ the fluid soap 102 for bathing. Additionally, the plurality of soap dispensers is laterally distributed along the door 36 of the gun safe 30.

Each of the plurality of soap dispensing units 100 comprises a soap bottle mount 104 which has a panel 106 that has a rear surface 108 that is bonded to a front surface 110 of the door 36 on the gun safe 30. The soap bottle mount 104 includes a pair of supports 112 which each extends forwardly from a front surface 114 of the panel 106 and each of the pair of supports 112 is spaced from a respective one of a top edge 116 and a bottom edge 118 of the panel 106. Each of the plurality of soap dispensing units 100 includes a soap bottle 120 which has a fill port 122 that is integrated into a top end 124 of the soap bottle 120 and a dispensing nozzle 126 which is integrated into a bottom end 128 of the soap bottle 120. The soap bottle 120 contains the fluid soap 102 and the soap bottle 120 is insertable into the pair of supports 112 on the panel 106 of the soap bottle mount 104 for mounting the soap bottle 120 to the door 36 of the gun safe 30. The fluid soap 102 contained in the soap bottle 120 may comprise body wash, shampoo or any other type of fluid soap that is commonly employed for bathing.

Each of the soap dispensing units 100 includes a cover 130 which has a forward wall 132 and an exterior wall 134 extending rearwardly from and surrounding the forward wall 132. A rear edge 136 of the exterior wall 134 corresponding to a top side 138 of the exterior wall 134 is hingedly coupled to the top edge 116 of the panel 106 of the soap bottle mount 104. The rear edge 136 of the exterior wall 134 rests against the front surface 114 of the of the panel 106 of the soap bottle mount 104 when the cover 130 is in a closed position such that the soap bottle 120 is enclosed in the cover 130. A bottom side 140 of the exterior wall 134 has a slot 142 extending through the bottom side 140 of the exterior wall 134 thereby enabling the dispensing nozzle 126 of the soap bottle 120 to extend downwardly through the slot 142 in the bottom side 140 of the exterior wall 134 when the cover 130 is in the closed position. The cover 130 has a viewing slot 144 which extends through the forward wall 132 of the cover 130 thereby enabling the soap bottle 120 to be visible through the viewing slot 144 to enable the user 34 to view the level of fluid soap 102 in the soap bottle 120. Additionally, the viewing slot 144 is elongated to extend substantially between the top side 138 of the exterior wall 134 and the bottom side 140 of the exterior wall 134.

Each of the soap dispensing units 100 includes a pump 146 which is movably integrated into the cover 130 such that pump 146 can be manipulated by the user 34. The pump 146 is in mechanical communication with the dispensing nozzle 126 of the soap bottle 120 when the cover 130 is in the closed position thereby enabling the pump 146 to release a measured amount of the fluid soap 102 from the dispensing nozzle 126 when the pump 146 is manipulated. In this way the pump 146 enables to user 34 to dispense the measured amount of the fluid soap 102 from the soap bottle 120. The pump 146 may comprise a manually operated fluid pump of any conventional design and the pump 146 may include a circular push button 148 that can be depressed by the user 34 and a pumping mechanism 150 that is actuated by the circular push button 148 for urging the measured amount of the fluid soap 102 from the dispensing nozzle 126.

Figure 11:
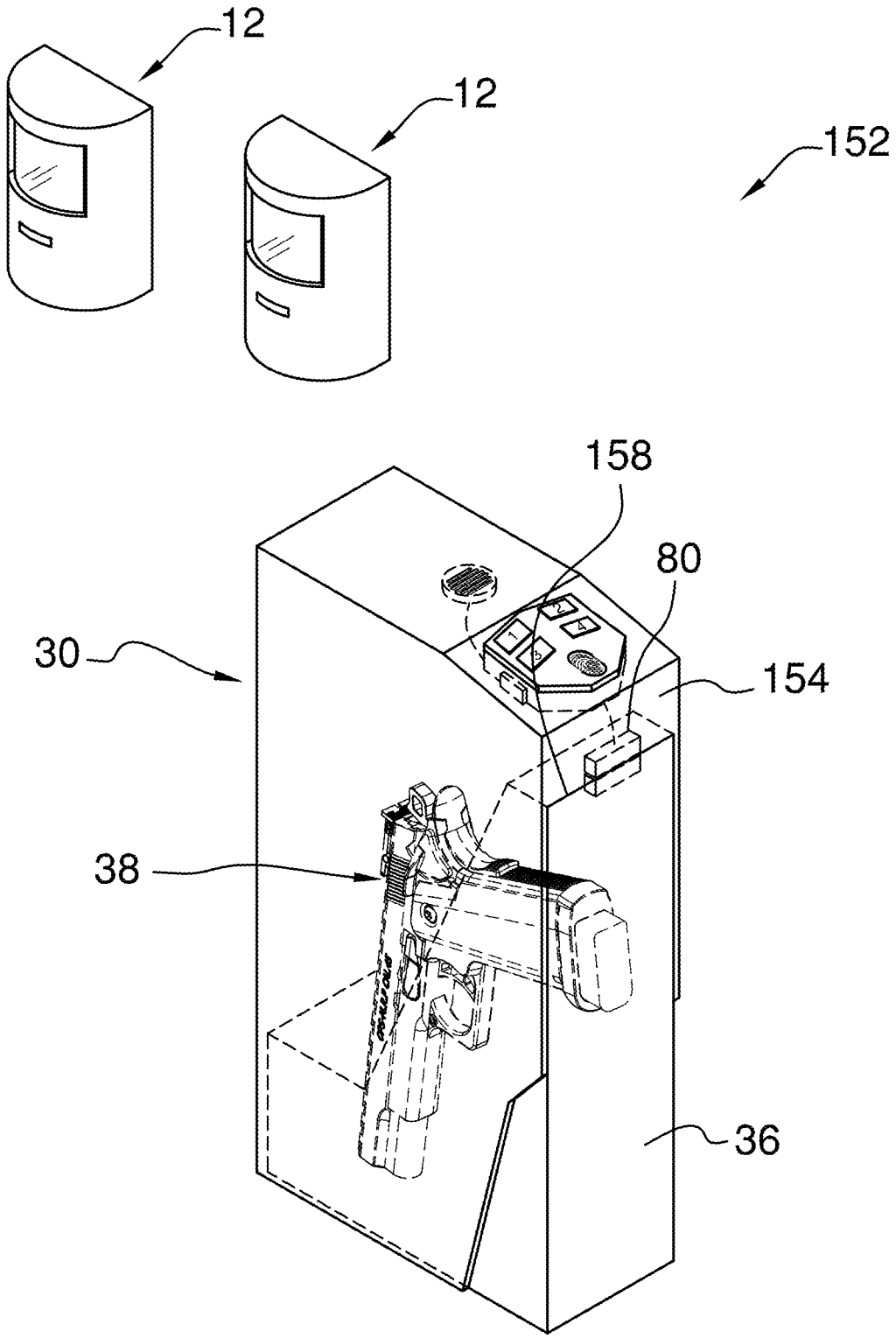
FIG. 11 is a perspective view of an alternative embodiment of the disclosure.
Figure 12:
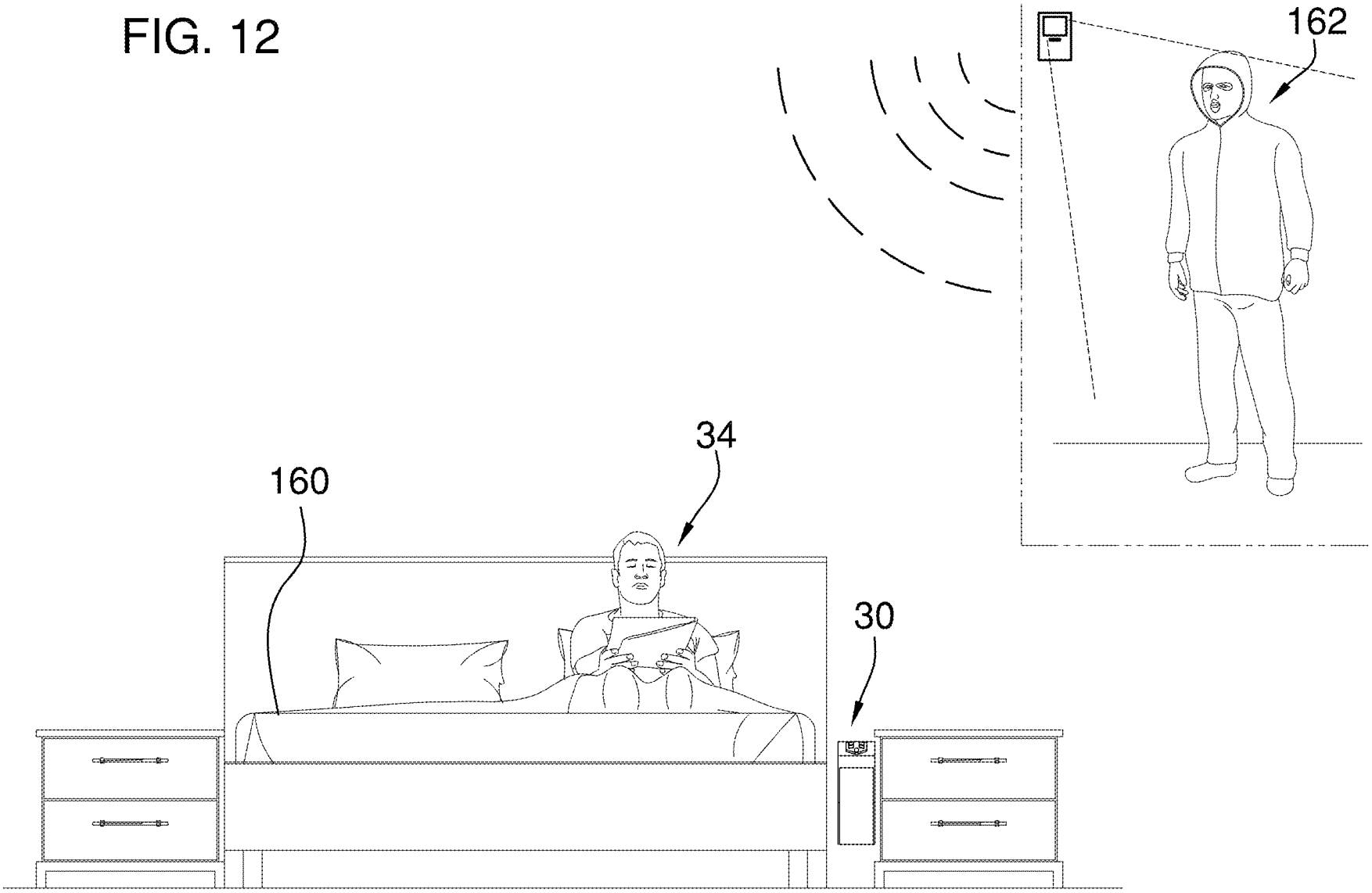
FIG. 12 is a perspective in-use view of an alternative embodiment of the disclosure.

In an alternative embodiment 152 shown in FIGS. 11 and 12, the door 36 of the gun safe 30 is hingedly integrated into a front wall 154 of the gun safe 30 and the door 36 tilts forwardly away from the front wall when the door 36 is in the open position. As is shown in FIG. 11, the door 36 has storage compartment 156 in which the firearm 38 is positioned thereby enabling the door 36 to expose the firearm 38 to the user 34 when the door 36 is in the open position. As is additionally shown in FIG. 11, the mechanized lock 80 engages an upper end 158 of the door 36 when the door 36 is in the closed position. As is shown in FIG. 12, the gun safe 30 can positioned near a bed 160 upon which the user 34 sleeps to enable the user 34 to retrieve the firearm 38 from the storage compartment in the door 36 when the door 36 is positioned in the open position.

In use, the electronic timer 72 is actuated with the key pad 82 when the user 34 enters the shower 32 to actuate the gun safe control processor 70. In this way the speaker 98 will emit the audible alert when any of the motion sensing units 12 senses motion while the user 34 is bathing in the shower 32. Thus, the user 34 is notified of the presence of a potential home intruder 162 while the user 34 is bathing in the shower 32. The user 34 employs either the key pad 82 or the biometric scanner 90 to unlock the door 36 and subsequently retrieve the firearm 38 from the gun safe 30. In this way the user 34 can defend themselves against the potential home intruder 162 while the user 34 is bathing in the shower 32. The user 34 would typically be unaware of the presence of the potential home intruder 162 while the user 34 is bathing and the user 34 would also typically be unable to defend themselves while bathing in the shower 32. The gun safe 30 and the communication unit 68 ensure that not only will the user 34 be notified of the presence of the potential home intruder 162 while the user 34 is bathing in the shower 32 and that the user 34 will also have immediate access to the firearm 38 to defend themselves in an otherwise vulnerable situation. The plurality of soap dispensing units 100 on the gun safe 30 can be employed by the user 34 to dispense the fluid soap 102 for the user 34 to employ for washing themselves while the user 34 is bathing in the shower 32. Additionally, the soap bottle 120 in a respective soap dispensing unit 100 can be removed from the respective soap dispensing unit 100 and refilled with the fluid soap 102 as needed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shower mounted gun safe device for enabling a user to have access to a firearm when the user is showering thereby enabling the user to defend themselves in the event of a home invasion while the user is showering, said device comprising:

a plurality of motion sensing units, each of said plurality of motion sensing units being mountable within an occupancy wherein each of said plurality of motion sensing units is configured to sense motion within said occupancy, each of said plurality of motion sensing units having the capacity to broadcast an alert signal, a respective one of said motion sensing units broadcasting said alert signal when said respective motion sensing unit senses motion within said occupancy;

a gun safe being comprised of a fluid impermeable material thereby enabling said gun safe to be mounted in a shower wherein said gun safe is configured to be accessible to a user while the user is bathing in said shower, said gun safe having a door being hingedly attached to said gun safe, said door forming a fluid impermeable seal with said gun safe when said door is in a closed position wherein said door is configured to inhibit water from entering said gun safe thereby protecting a firearm which is stored in said gun safe from becoming wet while the user is bathing in said shower;

a communication unit being integrated into said gun safe, said communication unit being in wireless communication with each of said plurality of motion sensing units thereby enabling said communication unit to receive said alert signal from any of said motion sensing units;

a locking unit being integrated into said gun safe, said locking unit being in mechanical communication with said door, said locking unit locking said door when said door is in said closed position wherein said locking unit is configured to restrict access to the firearm that is stored within said gun safe, said locking unit being actuatable into an unlocked condition thereby enabling said door to be positioned in an open position wherein said locking unit is configured to permit access to the firearm stored within said gun safe; and a plurality of soap dispensing units, each of said plurality of soap dispensing units being attached to said door of said gun safe wherein each of said plurality of soap dispensing units is configured to be accessible to the user when the user is bathing in said shower, each of said plurality of soap dispensing units containing a fluid soap being dispensable from said soap dispensing units wherein said plurality of soap dispensing units is configured to enable the user to employ said fluid soap for bathing.

2. The device according to claim 1, wherein:

each of said plurality of motion sensing units comprises:

a motion housing having a back wall and a forward wall curving forwardly from said back wall such that said motion housing has a semi- cylindrical shape, said back wall being mountable to an interior wall of said occupancy;

a motion control processor being integrated into said motion housing, said motion control processor receiving a motion input, said motion control processor being electrically coupled to a power source comprising an electrical system of said occupancy;

a motion sensor being integrated into said forward wall of said motion housing wherein said motion sensor is configured to sense motion within said occupancy, said motion sensor being electrically coupled to said motion control processor, said motion control processor receiving said motion input when said motion sensor senses motion; and a transmitter being integrated into said motion housing, said transmitter being electrically coupled to said motion control processor, said transmitter broadcasting said alert signal when said motion control processor receives said motion input;

said communication unit comprises:

a gun safe control processor being integrated into said gun safe, said gun safe control processor receiving an alert input, said gun safe control processor receiving an unlock input, said gun safe control processor including an electronic timer, said electronic timer being programmable to count down a duration of time which corresponds to the duration of time that the user will be bathing in said shower, said gun safe control processor being enabled when said electronic timer begins counting down said duration of time, said gun safe control processor being disabled when said electronic timer finishes counting down said duration of time, a receiver being integrated into said gun safe, said receiver being electrically coupled to said gun safe control processor, said receiver being in wireless communication with said transmitter in each of said plurality of motion sensing units thereby enabling said receiver to receive said alert signal from said transmitter in any of said motion sensing units, said gun safe control processor receiving said alert input when said receiver receives said alert signal from said transmitter in any of said motion sensing units; and a power supply being integrated into said gun safe, said power supply being electrically coupled to said gun safe control processor, said power supply comprising at least one battery.

3. The device according to claim 2, wherein:

said gun safe has a rear wall and an outer wall extending forwardly from said rear wall and surrounding said rear wall such that said outer wall defines an interior space in said gun safe wherein said interior space is configured to contain the firearm;

a lower side of an exterior surface of said door is hingedly coupled to a lower side of an interior surface of said outer wall;

said exterior surface of said door rests against and is surrounded by said interior surface of said outer wall when said door is in said closed position; and said gun safe has a plurality of sound slots each extending through said outer wall of said gun safe wherein said plurality of sound slots is configured to enable sound to pass through said plurality of sound slots.

4. The device according to claim 3, wherein said device includes a plurality of mounting panels;

each of said plurality of mounting panels is attached to an outwardly facing surface of said rear wall of said gun safe;

each of said plurality of mounting panels engages a wall of said shower thereby attaching said rear wall of said gun safe to said wall of said shower;

said plurality of mounting panels is arranged in a pair of columns extending substantially between a top side and said lower side of said outer wall of said gun safe;

said device includes a gasket being attached to said exterior surface of said door;

said gasket is continuous such that said gasket extends around a full perimeter of said exterior surface of said door;

said gasket abuts against said interior surface of said outer wall of said gun safe when said door is in said closed position; and said gasket is comprised of a fluid impermeable material thereby enabling said gasket to form said fluid impermeable seal with said interior surface of said outer wall of said gun safe when said door is in said closed position wherein said gasket is configured to inhibit water from entering said gun safe when said door is in said closed position.

5. The device according to claim 3, wherein:

said communication unit includes a gun safe control processor being integrated into said gun safe, said locking unit comprises:

a mechanized lock being integrated into said outer wall of said gun safe, said mechanized lock is electrically coupled to said gun safe control processor;

said mechanized lock is biased into a locking condition having said mechanized lock engaging said exterior surface of said door when said door is in said closed position thereby inhibiting said door from being positioned into said open position;

said mechanized lock being actuated to disengage said exterior surface of said door when said gun safe control processor receives said unlock input thereby enabling said door to be positioned into said open position;

a key pad being integrated into a top side of an outer surface of said outer wall of said gun safe wherein said key pad is configured to be accessible to the user when the user is bathing in said shower, said key pad including a plurality of alpha-numeric keys, said key pad being electrically coupled to said gun safe control processor, said gun safe control processor receiving said unlock input when said plurality of alpha-numeric keys are depressed to enter a pre-determined unlock code which has been previously established by the user;

a biometric scanner being integrated into said top side of said outer surface of said outer wall of said gun safe wherein said biometric scanner is configured to enable the user to position the user's thumb against said biometric scanner, said biometric scanner being electrically coupled to said gun safe control processor, said gun safe control processor receiving said unlock input when said biometric scanner scans data from the user's thumb; and a keyhole being integrated into said outer wall of said gun safe thereby enabling said keyhole to insertably receive a key thereby enabling said key to be in mechanical communication with said mechanized lock for manually disengaging said mechanized lock from said exterior surface of said door thereby enabling said door to be positioned into said open position.

6. The device according to claim 5, wherein:

said locking unit includes a speaker being integrated into said outer wall of said gun safe;

said speaker is electrically coupled to said gun safe control processor;

said speaker is actuated to emit an audible alarm when said gun safe control processor receives said alert input;

said speaker is aligned with said plurality of sound slots in said outer wall of said gun safe wherein said speaker is configured to enable the user to hear said audible alarm to alert the user to unlock said gun safe to retrieve the firearm from said gun safe.

7. The device according to claim 1, wherein:

each of said plurality of soap dispensing units includes a soap bottle mount having a panel which has a rear surface being bonded to a front surface of said door on said gun safe;

said soap bottle mount includes a pair of supports which each extends forwardly from a front surface of said panel;

each of said pair of supports is spaced from a respective one of a top edge and a bottom edge of said panel; and each of said plurality of soap dispensing units includes a soap bottle having a fill port being integrated into a top end of said soap bottle and a dispensing nozzle being integrated into a bottom end of said soap bottle;

said soap bottle contains said fluid soap; and said soap bottle is insertable into said pair of supports on said panel of said soap bottle mount for mounting said soap bottle to said door of said gun safe.

8. The device according to claim 7, wherein:

each of said plurality of soap dispensing units includes a cover having a forward wall and an exterior wall extending rearwardly from and surrounding said forward wall of said cover;

a rear edge of said exterior wall corresponding to a top side of said exterior wall is hingedly coupled to said top edge of said panel of said soap bottle mount;

said rear edge of said exterior wall rests against said front surface of said panel of said soap bottle mount when said cover is in a closed position such that said soap bottle is enclosed in said cover;

a bottom side of said exterior wall has a slot extending through said bottom side of said exterior wall thereby enabling said dispensing nozzle of said soap bottle to extend downwardly through said slot in said bottom side of said exterior wall when said cover is in said closed position;

said cover has a viewing slot extending through said forward wall of said cover thereby enabling said soap bottle to be visible through said viewing slot wherein said viewing slot is configured to enable the user to view a level of fluid soap in said soap bottle; and said viewing slot is elongated to extend substantially between said top side of said exterior wall and said bottom side of said exterior wall.

9. The device according to claim 8, wherein:

each of said plurality of soap dispensing units includes a pump being movably integrated into said cover wherein pump is configured to be manipulated by the user; and said pump is in mechanical communication with said dispensing nozzle of said soap bottle when said cover is in said closed position thereby enabling said pump to release a measured amount of said fluid soap from said dispensing nozzle when said pump is manipulated wherein said pump is configured to enable to user to dispense said measured amount of said fluid soap from said soap bottle.

10. A shower mounted gun safe device for enabling a user to have access to a firearm when the user is showering thereby enabling the user to defend themselves in the event of a home invasion while the user is showering, said device comprising:

a plurality of motion sensing units, each of said plurality of motion sensing units being mountable within an occupancy wherein each of said plurality of motion sensing units is configured to sense motion within said occupancy, each of said plurality of motion sensing units having the capacity to broadcast an alert signal, a respective one of said motion sensing units broadcasting said alert signal when said respective motion sensing unit senses motion within said occupancy, each of said plurality of motion sensing units comprising:

a motion housing having a back wall and a forward wall curving forwardly from said back wall such that said motion housing has a semi- cylindrical shape, said back wall being mountable to an interior wall of said occupancy;

a motion control processor being integrated into said motion housing, said motion control processor receiving a motion input, said motion control processor being electrically coupled to a power source comprising an electrical system of said occupancy;

a motion sensor being integrated into said forward wall of said motion housing wherein said motion sensor is configured to sense motion within said occupancy, said motion sensor being electrically coupled to said motion control processor, said motion control processor receiving said motion input when said motion sensor senses motion; and a transmitter being integrated into said motion housing, said transmitter being electrically coupled to said motion control processor, said transmitter broadcasting said alert signal when said motion control processor receives said motion input;

a gun safe being comprised of a fluid impermeable material thereby enabling said gun safe to be mounted in a shower wherein said gun safe is configured to be accessible to a user while the user is bathing in said shower, said gun safe having a door being hingedly attached to said gun safe, said door forming a fluid impermeable seal with said gun safe when said door is in a closed position wherein said door is configured to inhibit water from entering said gun safe thereby protecting a firearm which is stored in said gun safe from becoming wet while the user is bathing in said shower, said gun safe having a rear wall and an outer wall extending forwardly from said rear wall and surrounding said rear wall such that said outer wall defines an interior space in said gun safe wherein said interior space is configured to contain the firearm, a lower side of an exterior surface of said door being hingedly coupled to a lower side of an interior surface of said outer wall, said exterior surface of said door resting against and being surrounded by said interior surface of said outer wall when said door is in said closed position, said gun safe having a plurality of sound slots each extending through said outer wall of said gun safe wherein said plurality of sound slots is configured to enable sound to pass through said plurality of sound slots;

a plurality of mounting panels, each of said plurality of mounting panels being attached to an outwardly facing surface of said rear wall of said gun safe, each of said plurality of mounting panels engaging a wall of said shower thereby attaching said rear wall of said gun safe to said wall of said shower, said plurality of mounting panels being arranged in a pair of columns extending substantially between a top side and said lower side of said outer wall of said gun safe;

a gasket being attached to said exterior surface of said door, said gasket being continuous such that said gasket extends around a full perimeter of said exterior surface of said door, said gasket abutting against said interior surface of said outer wall of said gun safe when said door is in said closed position, said gasket being comprised of a fluid impermeable material thereby enabling said gasket to form a fluid impermeable seal with said interior surface of said outer wall of said gun safe when said door is in said closed position wherein said gasket is configured to inhibit water from entering said gun safe when said door is in said closed position;

a communication unit being integrated into said gun safe, said communication unit being in wireless communication with each of said plurality of motion sensing units thereby enabling said communication unit to receive said alert signal from any of said motion sensing units, said communication unit comprising:

a gun safe control processor being integrated into said gun safe, said gun safe control processor receiving an alert input, said gun safe control processor receiving an unlock input, said gun safe control processor including an electronic timer, said electronic timer being programmable to count down a duration of time which corresponds to the duration of time that the user will be bathing in said shower, said gun safe control processor being enabled when said electronic timer begins counting down said duration of time, said gun safe control processor being disabled when said electronic timer finishes counting down said duration of time, a receiver being integrated into said gun safe, said receiver being electrically coupled to said gun safe control processor, said receiver being in wireless communication with said transmitter in each of said plurality of motion sensing units thereby enabling said receiver to receive said alert signal from said transmitter in any of said motion sensing units, said gun safe control processor receiving said alert input when said receiver receives said alert signal from said transmitter in any of said motion sensing units; and a power supply being integrated into said gun safe, said power supply being electrically coupled to said gun safe control processor, said power supply comprising at least one battery;

a locking unit being integrated into said gun safe, said locking unit being in mechanical communication with said door, said locking unit locking said door when said door is in said closed position wherein said locking unit is configured to restrict access to the firearm that is stored within said gun safe, said locking unit being actuatable into an unlocked condition thereby enabling said door to be positioned in an open position wherein said locking unit is configured to permit access to the firearm stored within said gun safe, said locking unit comprising:

a mechanized lock being integrated into said outer wall of said gun safe, said mechanized lock being electrically coupled to said gun safe control processor, said mechanized lock being biased into a locking condition having said mechanized lock engaging said exterior surface of said door when said door is in said closed position thereby inhibiting said door from being positioned into said open position, said mechanized lock being actuated to disengage said exterior surface of said door when said gun safe control processor receives said unlock input thereby enabling said door to be positioned into said open position;

a key pad being integrated into said top side of an outer surface of said outer wall of said gun safe wherein said key pad is configured to be accessible to the user when the user is bathing in said shower, said key pad including a plurality of alpha-numeric keys, said key pad being electrically coupled to said gun safe control processor, said gun safe control processor receiving said unlock input when said plurality of alpha-numeric keys are depressed to enter a predetermined unlock code which has been previously established by the user;

a biometric scanner being integrated into said top side of said outer surface of said outer wall of said gun safe wherein said biometric scanner is configured to enable to user to position the user's thumb against said biometric scanner, said biometric scanner being electrically coupled to said gun safe control processor, said gun safe control processor receiving said unlock input when said biometric scanner scans data from the user's thumb;

a keyhole being integrated into said outer wall of said gun safe thereby enabling said keyhole to insertably receive a key thereby enabling said key to be in mechanical communication with said mechanized lock for manually disengaging said mechanized lock from said exterior surface of said door thereby enabling said door to be positioned into said open position; and a speaker being integrated into said outer wall of said gun safe, said speaker being electrically coupled to said gun safe control processor, said speaker being actuated to emit an audible alarm when said gun safe control processor receives said alert input, said speaker being aligned with said plurality of sound slots in said outer wall of said gun safe wherein said speaker is configured to enable the user to hear said audible alarm to alert the user to unlock said gun safe to retrieve the firearm from said gun safe; and a plurality of soap dispensing units, each of said plurality of soap dispensing units being attached to said door of said gun safe wherein each of said plurality of soap dispensing units is configured to be accessible to the user when the user is bathing in said shower, each of said plurality of soap dispensing units containing a fluid soap being dispensable from said soap dispensing units wherein said plurality of soap dispensing units is configured to enable to user to employ said fluid soap for bathing, said plurality of soap dispensers being laterally distributed along said door of said gun safe, each of said plurality of soap dispensing units comprising:

a soap bottle mount having a panel which has a rear surface being bonded to a front surface of said door on said gun safe, said soap bottle mount including a pair of supports which each extends forwardly from a front surface of said panel, each of said pair of supports being spaced from a respective one of a top edge and a bottom edge of said panel;

a soap bottle having a fill port being integrated into a top end of said soap bottle and a dispensing nozzle being integrated into a bottom end of said soap bottle, said soap bottle containing said fluid soap, said soap bottle being insertable into said pair of supports on said panel of said soap bottle mount for mounting said soap bottle to said door of said gun safe;

a cover having a forward wall and an exterior wall extending rearwardly from and surrounding said forward wall of said cover, a rear edge of said exterior wall corresponding to a top side of said exterior wall being hingedly coupled to said top edge of said panel of said soap bottle mount, said rear edge of said exterior wall resting against said front surface of said panel of said soap bottle mount when said cover is in a closed position such that said soap bottle is enclosed in said cover, a bottom side of said exterior wall having a slot extending through said bottom side of said exterior wall thereby enabling said dispensing nozzle of said soap bottle to extend downwardly through said slot in said bottom side of said exterior wall when said cover is in said closed position, said cover having a viewing slot extending through said forward wall of said cover thereby enabling said soap bottle to be visible through said viewing slot wherein said viewing slot is configured to enable the user to view a level of fluid soap in said soap bottle, said viewing slot being elongated to extend substantially between said top side of said exterior wall and said bottom side of said exterior wall; and a pump being movably integrated into said cover wherein pump is configured to be manipulated by the user, said pump being in mechanical communication with said dispensing nozzle of said soap bottle when said cover is in said closed position thereby enabling said pump to release a measured amount of said fluid soap from said dispensing nozzle when said pump is manipulated wherein said pump is configured to enable to user to dispense said measured amount of said fluid soap from said soap bottle.

11. The device according to claim 10, wherein:

said door of said gun safe is hingedly integrated into a front wall of said gun safe;

said door tilts forwardly away from said front wall when said door is in said open position;

said door has a storage compartment in which the firearm is positioned wherein said door is configured to expose the firearm to the user when said door is in said open position; and said mechanized lock engages an upper end of said door when said door is in said closed position.

12. The device according to claim 11, wherein said gun safe is positioned near a bed upon which the user sleeps wherein said gun safe is configured to enable the user to retrieve the firearm from said storage compartment in said door when said door is positioned in said open position.

* * * * *